United States Patent [19]

Le Poittevin

[11] Patent Number: 4,635,412

[45] Date of Patent: Jan. 13, 1987

[54] FOLDING HOUSE TRANSPORTABLE IN THE FORM OF A STACKABLE CONTAINER

[76] Inventor: Yves M. J. Le Poittevin, 40 Avenue Marceau, Paris 8, France

[21] Appl. No.: 750,697

[22] Filed: Jun. 28, 1985

[51] Int. Cl.[4] ..... E04B 1/344

[52] U.S. Cl. ..... 52/79.5; 280/763.1

[58] Field of Search ..... 52/79.5, 79.1, 71; 280/763.1

[56] References Cited

U.S. PATENT DOCUMENTS

| | | | |
|---|---|---|---|
| 2,155,876 | 4/1939 | Stout | 52/71 |
| 2,765,499 | 10/1956 | Couse | 52/79.5 |
| 3,257,760 | 6/1966 | Calthorpe | 52/71 |
| 3,292,314 | 12/1966 | Heise | 52/79.5 |
| 3,360,891 | 1/1968 | Gardner | 52/71 |
| 3,593,471 | 7/1971 | Fields | 52/79.5 |
| 3,763,607 | 10/1973 | Glover | 52/71 |
| 3,792,558 | 2/1974 | Berce | 52/79.5 |
| 4,070,804 | 1/1978 | Van Der Lely | 52/79.5 |
| 4,155,204 | 5/1979 | Prozinski | 52/71 |
| 4,242,846 | 1/1981 | Hurd | 52/71 |

*Primary Examiner*—John E. Murtagh

*Attorney, Agent, or Firm*—McGlew and Tuttle

[57] ABSTRACT

In this house, at least some of its component parts in the opened out position constitute, when the house is in the folded up position, a stackable container which is closed, compact and homogeneous throughout its length, within which container are disposed, folded up, all the other elements of the house, and in particular means a ladder-grider ensuring the stability and the bracing of the unfolded house and the longitudinal bending strength of the container formed by the folded up house.

5 Claims, 15 Drawing Figures

30
24
28
26
16
24
28
12
58
56
31
7
11
36
34
38
37
33
35
55
32

FOLDING HOUSE TRANSPORTABLE IN THE FORM OF A STACKABLE CONTAINER

BACKGROUND OF THE INVENTION

The present invention relates to a folding house designed in particular to be transported in the form of a stackable container.

Folding houses are known which have in the folded up position a width equal to or less than that of the road gauge and, in the unfolded or opened out position, a width about three times the preceding width, the reduction in the width for transport being achieved by the folding up, on each side of a central cell, of gable, outer wall, floor and roof panels.

The volume of these folded houses adapts them to transport, even on the road, but the height of these unfolded houses is at the most equal to the height of these houses when folded up.

Folding houses are also known which are similar to the preceding houses but equipped in their central part with an additional folding superstructure which is converted, when opened out, into a partly usable roof structure.

A drawback of the aforementioned houses is that their structure does not permit the stacking thereof.

Extensible transportable houses are also known which consist of a steel structure conforming to the dimensions and performances prescribed by the rules defining ISO containers.

They are extended by the outward translation of tridimensional shells which are integrated within the basic structure for transport.

Such houses are easily transportable and stackable but they have the drawback of a limited extension, since the width of the opened out house cannot exceed twice its width in the transport position and its height cannot exceed the height of the transported unit.

There exists an easily transportable and stackable house having the additional advantage of being equipped with autonomous loading and unloading means. Its structure is that of an ISO container and its handling devices are vertical telescopic racks placed close to the four corners of the container. As they are mounted on pivotable brackets, these racks are integrated for transport within cavities provided for this purpose in the sides of the container, and, in the position of use, they are opened out on each side of the container by pivoting on vertical axes of the brackets.

However, this house has the following drawbacks:

it is not extensible and any possible extensibility would be both limited and rendered more complicated by the presence of the rack cavities;

its handling devices consequently represent heavy equipment for a limited useful volume.

In contrast to the houses described hereinbefore, a house according to the present convention has the following advantages:

it has in the opened out position a height and a width, and consequently also a volume, which are greater:

in the folded up position, it forms a rigid, homogeneous container whose dimensions, characteristics and performances may be in conformity with the requirements of the ISO standards defining containers, and in particular the standards No. 668 and No. 1161, with all the resulting advantages for handling and transport.

SUMMARY OF THE INVENTION

For this purpose, according to a feature of the invention, the structure of the house comprises an axial bay constructed in the form of a ladder-girder which, without constituting an obstacle to interior circulation, imparts thereto stability and bracing while ensuring that the container formed by the house in the folded up position has a longitudinal bending strength allowing its handling and even its transport merely by its ends. Also, owing to such a girder no bending stress will oppose the folding of the longitudinal panels.

According to another feature this ladder-girder receives all the technical equipment which, bearing in mind all the imposed requirements, groups it advantageously in a well-structured zone.

According to a further feature of the invention, the median part of the roof structure is connected to posts mounted to pivot about horizontal pivots on said ladder-girder so that, while they are disposed horizontally in the transport position, they are disposed almost vertically when the house is opened out and thus raise the ridge of the roof well above the height of the container.

According to another feature of the invention, the house is provided, for reasons of autonomy, with its own devices for unloading from the transporting truck, and, owing it a particular arrangement of these devices, they can be used for the opening out of the house.

According to this arrangement, the unloading devices are located at the end of the container and are pivotable through 180° about a horizontal axis which permits, not only easily causing them to leave the gauge of the container in plan for effecting the unloading operations, but also giving them all the intermediate positions between the transport position and the unloading position for participating in the operations for unfolding the house.

Unloading devices are also known which are located on the sides of the container and mounted to pivot about a vertical axis so that it is possible to withdraw them into housings provided for this purpose so as to avoid reducing the section of the container throughout its length.

Apart from the drawback of these housings as concerns the interior geometry of the container, these devices can only move horizontally and therefore cannot take up positions required for opening out a house.

According to another feature of the invention, the strongest panels are used for forming the outer case of the container so as to protect the folded up house in the course of transport and, as it concerns floors, the final appearance of the unfolded house will not be affected by the usual unavoidable shocks and blows since the outer side of the panels during transport is no longer seen after the house has been opened out.

BRIEF DESCRIPTION OF THE DRAWINGS

Further features and advantages of a house according to the invention will appear from the following description with reference to an embodiment which is given merely by way of a non-limiting example. In the drawings.

DESCRIPTION OF THE PREFERRED EMBODIMENT

Figure 1:
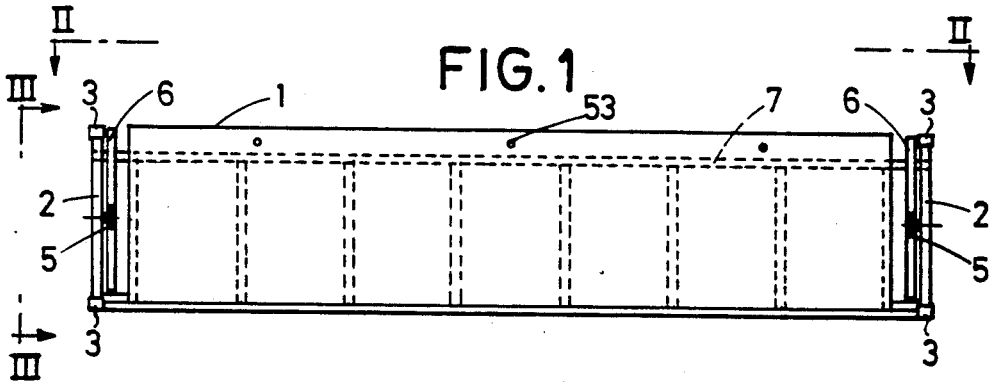
FIG. 1 is a side elevational view of a house according to the invention in its folded up position.
Figure 2:
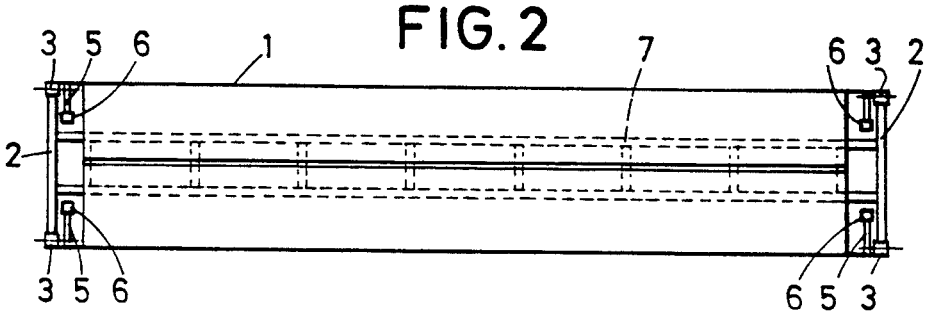
FIG. 2 is a view in the direction II—II of FIG. 1
Figure 4:
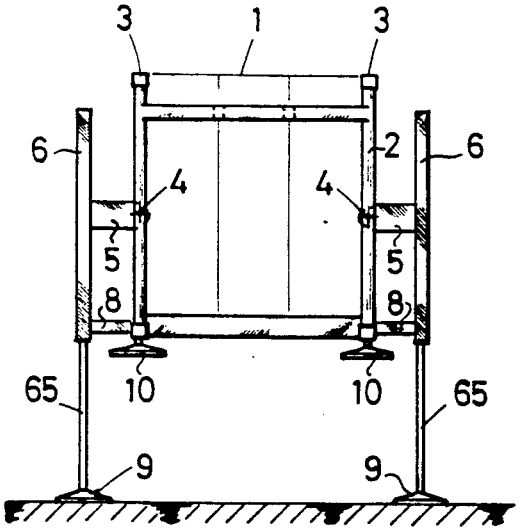
FIG. 4 is a view similar to FIG. 3, the house being in the course of unloading from its transporting means.

FIGS. 1, 2 and 4 show a container 1 constituted by a house according to the invention which has been folded up to permit its transport.

This container comprises, in its axial part, a ladder-girder 7 which terminates at each end in an end element 2 in the form of a tubular frame carrying the four standard corner blocks 3 of containers conforming to the ISO standard No. 1161.

Figure 3:
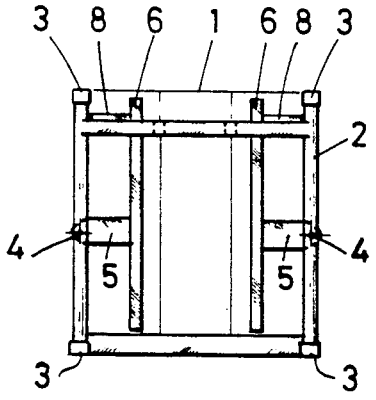
FIG. 3 is a view in the direction III—III of FIG. 1 to an enlarged scale.

Each upright of the end elements 2 carries a telescopic rack 6 through an arm 5 pivotally mounted thereon at 4, whereby each rack 6 is movable between the position it occupies in FIG. 3 and that which it occupies in FIG. 4.

In FIG. 3, the racks 6 are within the container and their lower part abuts under the effect of gravity against the sole plate constituting the floor of the container.

In FIG. 4, they have effected a rotation through 180° about the axis 4 and they are now located outside the gauge of the container in plan. Stop blocks 8 which abut against the sides of the floor of the container maintain them in this position.

Under these conditions, the container-house is unloaded in the following manner.

With the truck transporting the container in a position in which the container is vertically above the place it must occupy on the ground, the four racks 6 are pivoted about the pivots 4 until they are located outside the gauge. Their telescopic rods 65 are provided with plates 9 and they are lowered not only until the plates 9 touch the ground, but also to raise the container 1 with respect to the carrying platform of the truck which can therefore be withdrawn.

In order to obtain the final placing and support of the container, the lower blocks 3 are provided with plates 10 and the container 1 is lowered by means of the racks 6 whose telescopic rods 65 are retracted until the plates 10 bear against the ground. The plates 9 are retracted still further until they may be withdrawn.

The operations for opening out the house may now commence.

Figure 5:
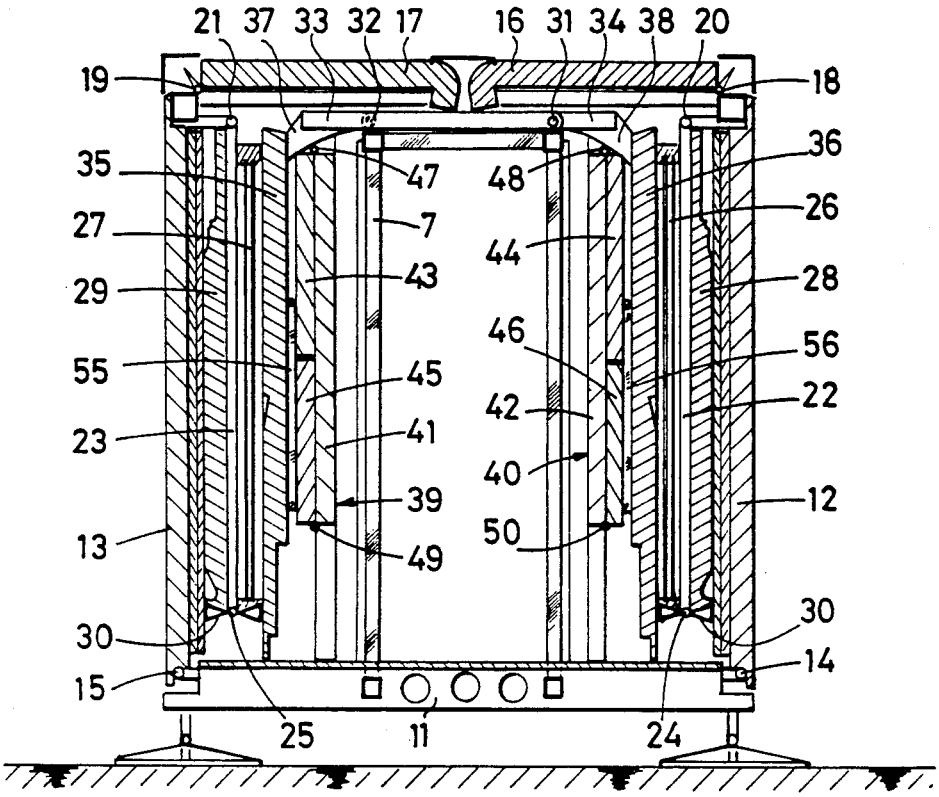
FIG. 5 is a cross-sectional view of the same house in its folded up position.

In order to explain these operations, FIG. 5 shows, after removal of end panels installed for the transport, all the elements which must be unfolded or opened out and the relationship therebetween. However, in order to render the drawing more clear, the technical equipment concerning the electricity, heating, airconditioning and sanitary equipment has not been shown in the median bay.

The ladder-girder 7 is of tubular construction except for the floor part where the cross-members are open section members so dimensioned as to permit the drillings required for the technical equipment and in particular the waste water pipes.

The floor of the house is formed by a fixed median part 11 and two lateral parts 12 and 13 pivotally connected at 14 and 15 to the median part.

The lateral part 12 of the floor carries, on one hand, a pivot 18 on which is pivotally mounted a corbelling panel 16 and, on the other hand, a pivot 20 on which is pivotally mounted the end of a structure 22 made from parallel posts spaced apart along the length of the house.

Likewise, the lateral part 13 of the floor carries, on one hand, a pivot 19 on which is pivotally mounted a corbelling panel 17 and, on the other hand, a pivot 21 on which is pivotally mounted the end of a structure 23 made from parallel posts spaced apart along the length of the house.

On some of the posts of the structures 22 and 23 there are vertically pivoted the panels which will close the interior rooms above the corbelling parts in continuation of transverse partitions, and the two panels located on each side of the entrance door when the latter is placed in one of the side walls of the house.

For purpose of transport, these panels, which are not seen in FIG. 5, are disposed between the posts within the thickness of the structures 22 and 23.

Figure 13:
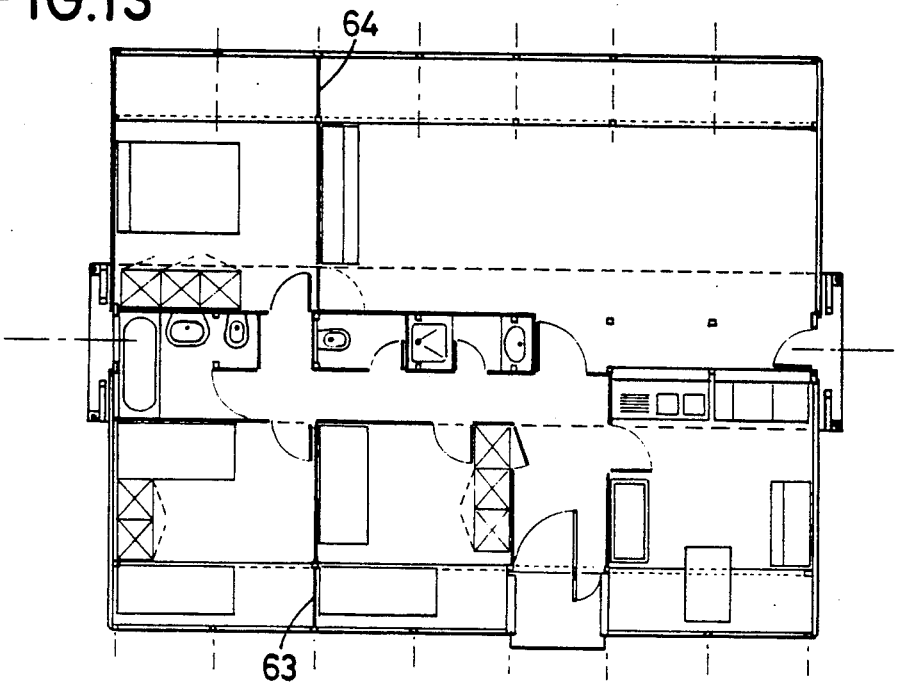
FIG. 13 is a plan view of the house.

They will appear in FIG. 13 in the opened out position.

The other end of the structure 22 carries a pivot 24 on which is pivotally mounted, on one hand, an outer wall 26 and, on the other hand, a roof element 28, both of which are provided on their edges with semi-section members 30.

Likewise, the other end of the structure 23 carries a pivot 25 on which are pivotally mounted, on one hand, an outer wall 27 and, on the other hand, a roof element 29, both of which are also provided on their edges with semi-section members 30.

Further, the ladder-girder carries two pivots 31 and 32 on its edges.

Pivotally mounted on the pivot 31 are the posts 33 which carry at their end a roof element 35 through gussets 37.

Likewise, pivotally mounted on the pivot 32 are posts 34 which carry at their end a roof element 36 through gussets 38.

The roof element 35 carries struts 55 which are pivotable about horizontal axes, while the roof element 36 carries struts 56 also pivotable about horizontal axes.

On each side and at the end of the ladder-girder 7 two elements 39 and 40 constitute the two folded gables of the house.

The element 39 comprises a main panel 41 a part of which is mounted on a vertical pin (not shown). On this panel 41, an upper panel 43 is mounted on a horizontal pivot 47 and a lower panel 45 is mounted on a second horizontal pivot 49.

Likewise, the element 40 comprises a main panel 42 a part of which is mounted on a vertical pin (not shown). On this panel 42, an upper panel 44 is mounted on a horizontal pivot 48 and a lower panel 46 is mounted on a second horizontal pivot 50.

The opening out of the house will now be described with reference to FIGS. 6, 7, 8, 9 and 10.

Before lowering the sides of the container (FIG. 6), so as to give them the position they must occupy as parts of the floor of the living quarters, the bearing plates 54 are placed in the cavities 53 provided for this purpose (51), and then a hoisting pulley 51, which may be rigged with pulley-blocks if desired, is provided on each of the upper two corner blocks 3 located adjacent to the side it is desired to shift and a cable 52 is passed around each of the these pulleys and is hooked in any known manner, for example, to hooks placed in the upper part of said side.

With the cables 52 hardly taut, the side of the container is first of all pivoted outwardly and, as soon as the centre of gravity of the pivoted elements becomes vertically above the pivot 14 or 15, it is sufficient to retain this side until the plates 54 reach the ground.

The operation is repeated on the other side for lowering the other side of the container.

It will be noted that the floor of the opened out house then occupies on the ground an area equivalent to at least two and a half times the area occupied by the container.

When the floor has been fully laid out flat, the elements 35 and 36 constituting the median part of the roof are placed in position.

For this purpose (FIG. 7), the pulleys 51 of the upper raising blocks 3 are withdrawn and the telescopic rods 65 of the racks 6 are provided with these pulleys in their upper part. These rods are then raised to the maximum since they will act as raising masts, so that the pulleys 51 are as high as possible.

A cable 52 is then passed out each pulley and the roof elements 35 and 36 are hooked to these cables for the purpose of raising them.

It will be understood that in the course of this raising the roof elements 35 turns about the pivot 31 and the roof element 36 turns about the pivot 32, which move the posts 33 and 34 from the horizontal position they occupied in the container to a roughly vertical position, which raises the upper edge of the roof and therefore raises the ridge of the unfolded house relative to the height of the container.

Owing to this raising of the roof which is added to the opening out of the floor, the opened out house has a volume which becomes more than three times its volume in the "container" position.

During the raising of the roof, the struts 55 and 56 mounted on the roof elements 35 and 36 by horizontal pivots, remain substantially vertical and, at the end of the travel, their lower ends are made to bear on the edges of the ladder-girder 7 and they are fixed thereto by any means which are not part of the invention.

As the median part of the roof is immoblized, it is necessary to proceed to the first stage of the positioning of the gables 39 and 40. In the container, they are disposed parallel to the sides of the latter and must be put on the exterior of the house in a position perpendicular to their position of transport. This is achieved by rotating the whole of each gable about the vertical pivot on which it is mounted.

Figure 7:
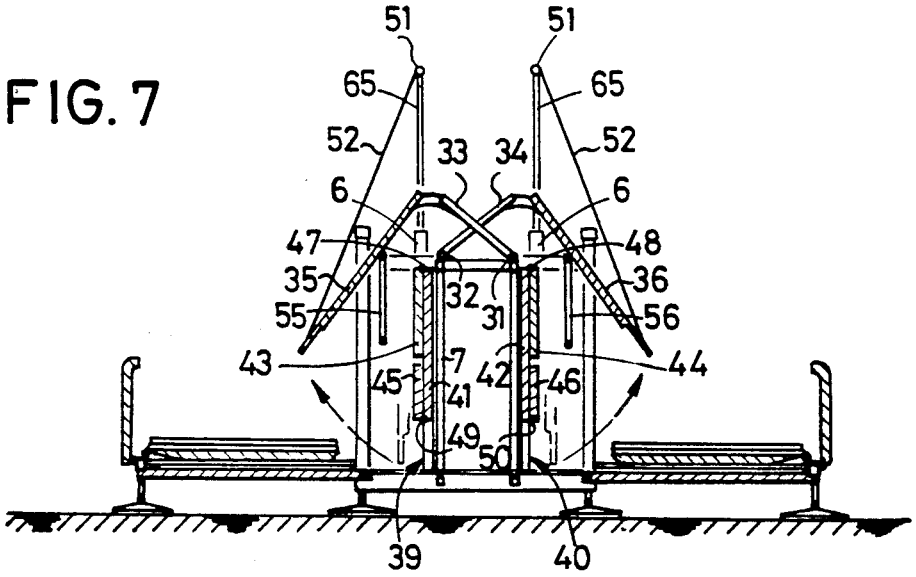
FIGS. 7, 8, 9 and 10 are diagrammatic sectional views of the same house at different stages of opening out.
Figure 6:
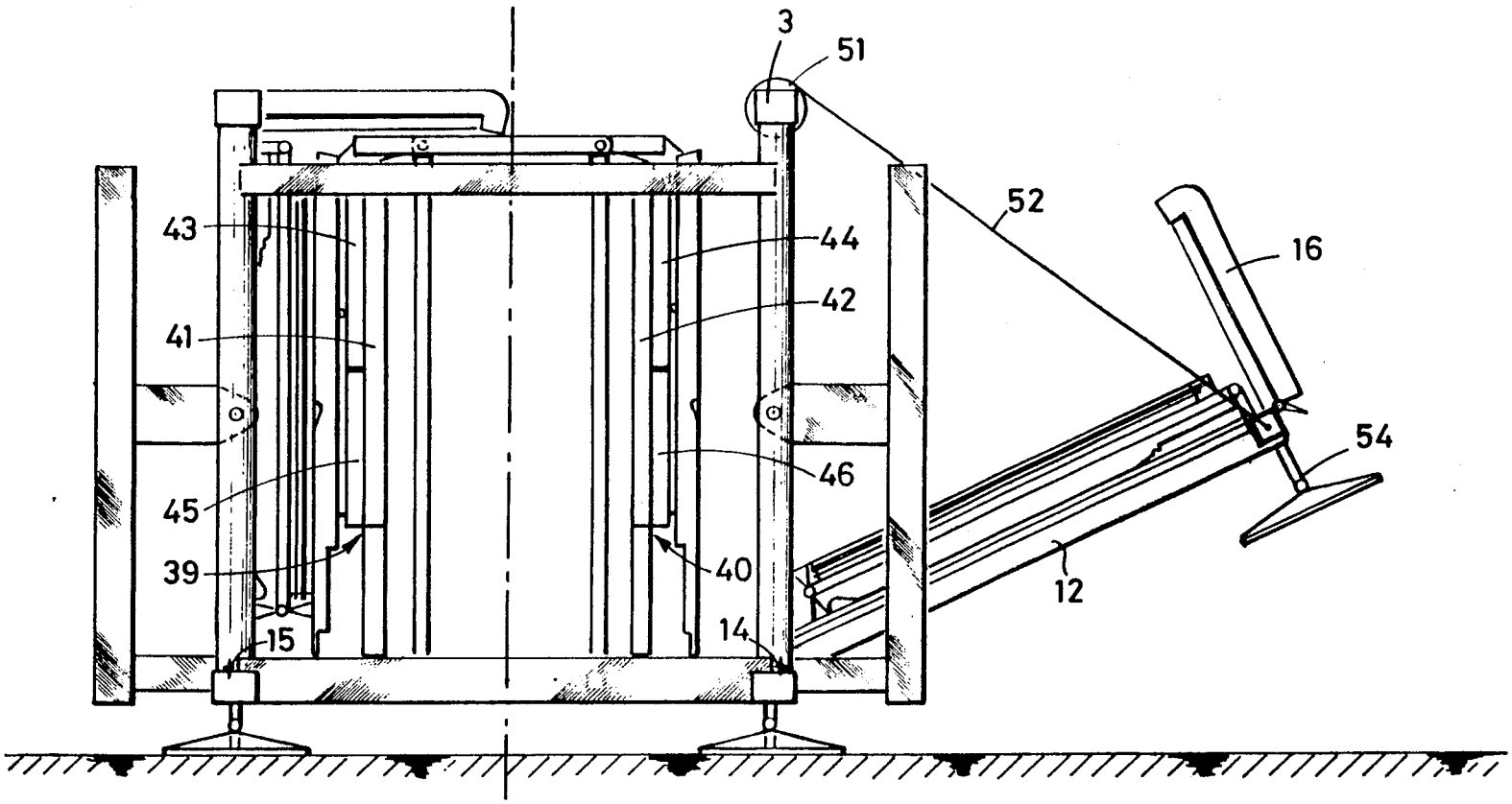
FIG. 6 is an end elevational view of the same house in the course of opening out the house.

In FIGS. 5, 6 and 7, the gables 39 and 40 are in the transport position and the upper panels 43 and 44 and the lower panels 45 and 46 are folded onto the panels 41 and 42.

Figure 8:
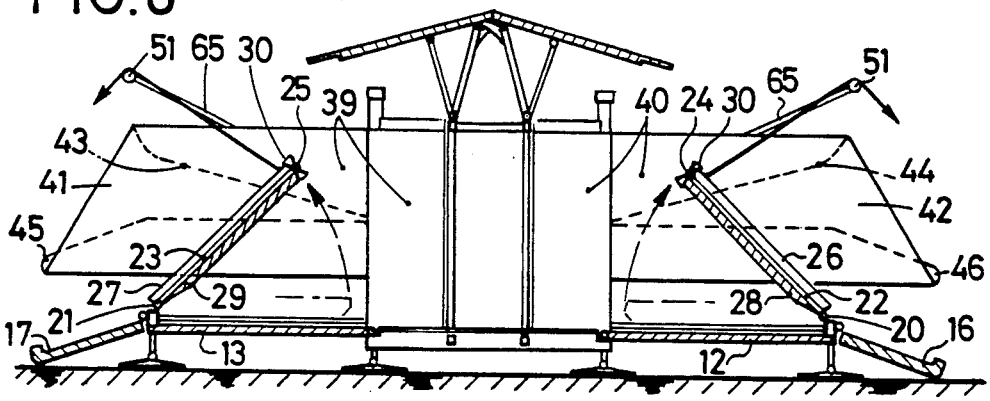
Figure 9:
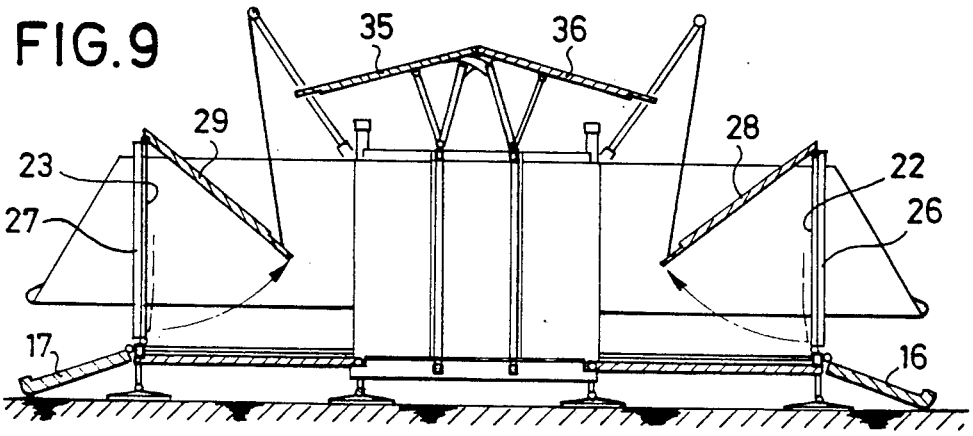
Figure 10:
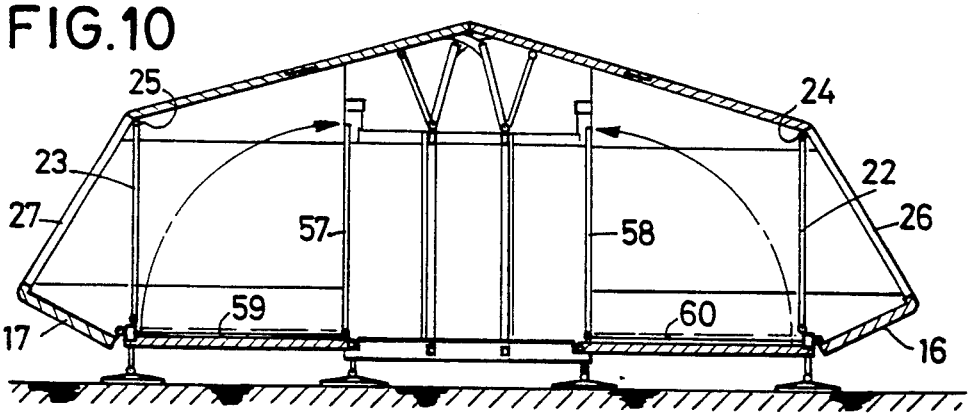

In FIGS. 8, 9 and 10, they have been disposed in the gable position but still with the upper and lower panels folded up as shown by dotted lines in FIG. 8.

The following stage of the opening out will be to place the roof elements 28 and 29 in position. But before explaining the various stages, it will be recalled that each of these elements is part of a unit.

The roof element 28 and the outer wall 26 are pivotally mounted at 24 on one end of structure 22 which is pivotally mounted at 20, at its other end, on the floor panel 12.

Likewise, the roof element 29 and the outer wall 27 are pivotally mounted at 25 on one end of the structure 23 which has its other end pivotally mounted at 21 on the floor panel 13.

For the moment, each of these units is flat on its floor panel and the first operation for opening out the roof elements 28 and 29 must be to bring these units to a vertical position.

For this purpose, after having pivoted the panels 16 and 17 down to the ground so as to avoid hindering the operation of the pivots 20 and 21, there are used as inclined raising masts the telescopic rods 65 of the racks 6 provided with their pulleys 51 (FIG. 8).

When the units 28, 26, 22 and 29, 27, 23 have been brought to the vertical position, they are locked by means which are not described since they are no part of the invention.

In the course of the raising of these units, there will be observed one of the functions of the semi-section members 30 with which the roof ends 28 and 29 and the front walls 26 and 27 are provided, on the edges. The opposition they exert through the web results in their acting as a beam which, in the course of the raising movement, opposes sufficient inertia to the bending stresses occurring in the course of this movement, so that it is possible to raise them by the ends.

Two other functions of these semi-section members will be seen hereinafter.

After locking the units 28, 26, 22 and 29, 27, 23 in the vertical position, the roof elements 28 and 29 (FIG. 9) are raised until their edge rabbets fit with the edge rabbets of the roof elements 35 and 36 and then they are interconnected. The overlapping of the elements 28 and 29 by the elements 35 and 36 produces a tile effect ensuring the running of rain water.

The following stage will comprise placing the outer walls 26 and 27 in position, these walls being at present in a vertical position against the structures 22 and 23 and must be brought to an inclined position (FIG. 10).

Indeed, on one hand, in order to have at least partial daily sunshine in each of the rooms of the house, irrespective of the orientation of the house and, on the other hand, in order to increase the interior volume, the outer walls 26 and 27 are inclined at about 30° to the vertical.

The outer walls are therefore raised and maintained in the raised position while the corbelling panels 16 and 17 are also raised—bearing in mind their weight this can be done easily by hand—these panels being then keyed to the outer walls by means which are not described since they are not part of the invention.

When one of the outer walls includes, as shown in FIG. 13, a door which must of course remain vertical while the window glazing must be inclined at 30°, it is constructed in the same way as the corbelling panel in two parts located on each side of the door. But the handling of each front wall element and each corresponding corbelling element is the same as for door-less front walls.

Figures 11, 11A:
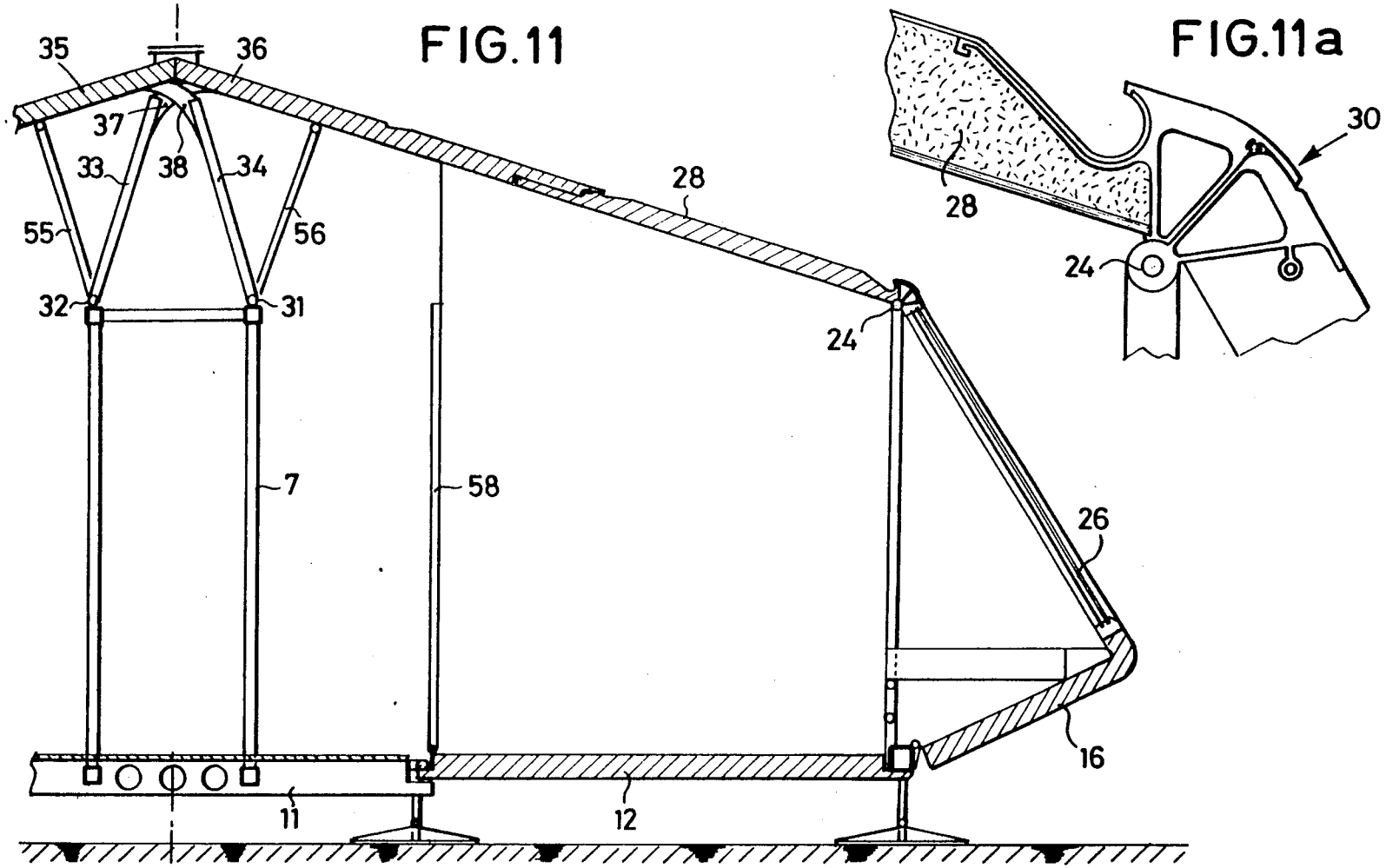
FIG. 11 is a sectional view of the same house in the opened out position.
FIG. 11*a* shows a detail of FIG. 11.

FIG. 11 illustrates the two functions of the semisection members 30 when the outer walls 26 and 27 and the roof elements 28 and 29 are in position in the opened out house.

On one hand, as they are mounted by a side, they form even in this position a beam which, in opposing the bending of the pivots 24 and 25, makes it possible to reduce the size of the structures 22 and 23 which carry these pivots.

On the other hand, they provide a seal at the junction between the outer walls and the roof, not only owing to the overlapping of the lower semi-section member by the upper semi-section member, but also owing to the fact that the upper semi-section member constitutes with a trough of the roof a true gutter, the overlapping and the gutter ensuring the running of rainwater out of the pivots 24 and 25.

Figure 12:
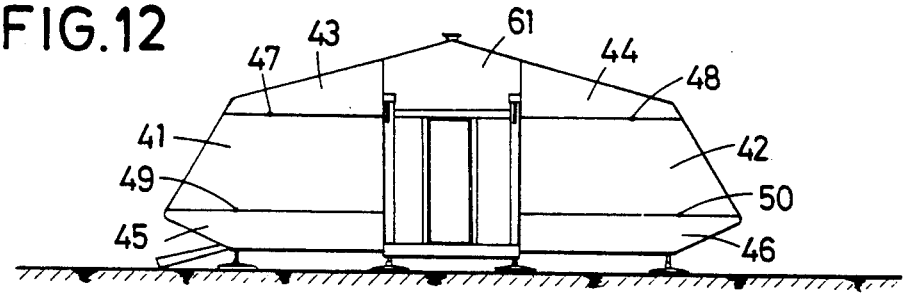
FIG. 12 is an end elevational view of the house after the gable has been mounted.

After the front walls and the corbellings have been placed in position, the opening out of the exterior of the house is terminated by opening out of the gables. For this purpose, it is sufficient to raise the panels 43 and 44 (FIG. 12) and make them pivot about the pivots 47 and 48 and lower the panels 44 and 46 by making them pivot about the pivots 49 and 50.

It will be seen that, in the opened out position, the panels 43 and 44 will leave the median upper part open on each gable. In order to completely close the gables, ridge panels 61 are provided which are not an integral part of the house but which are nonetheless transported with the latter folded up in the space left free by the technical equipment in the median bay.

FIG. 13 is a plan view of a house according to the invention constituting a container having a standard length of 12,192 mm and a width of 2,438 mm, the plan view being taken not on the floor level but on the base of the outer wall window glazing at the level of two horizontal shelves surmounting the corbellings.

This plan view shows that the presence of the corbellings markedly increases the interior area of the house which is, in the presently-described embodiment, about 95 $m^2$ at the level of the plan view as compared with a house whose outer walls would be in alignment with the structures 22 and 23 which would provide an interior area of about 75 $m^2$.

The entrance door is a pivoting door with an offset pivot axis. Its frame is formed by two posts of the structure 22 on which are pivotally mounted the two entrance sides closing the house above the corbelling panels and which, as mentioned before, were placed in the thickness of the structure 2 during transport of the folded up house.

Further, there can be seen the panels 63 and 64 which are provided for closing the interior rooms above the corbelling panels in continuation of the transverse partitions 59 and 60 and which were located for transport in the position shown in dotted lines, i.e. within the thickness of the structures 23 and 22.

This view shows that the sanitary equipment unit is installed in the median bay, i.e. within the ladder-girder 7. However, note the bath which exceeds the width of the latter. It concerns a bath capable of being swung up which was transported in the on-end position in the ladder-girder.

Because it was requested to provide a direct entrance into the living room and a reduction in the area of the kitchen, the sink and the cooking equipment of the kitchen were installed in the neighbouring bay of the ladder-girder 7. Both for transport, the sink and the cooking equipment, in one piece with their vertical partition placed behind, were disposed in the median bay on castors for the purpose of bringing them to their final position.

It must be understood that it is possible, without departing from the scope of the invention, to modify details of construction, their equipment or their arrangement so as to form equivalent modifications.

For example, in the case where there would be no entrance door in the outer wall, it would be possible to increase the inertia of the outer edge beams of the lateral floors so as to possibly eliminate the central plates 54 and/or shift the other plates 54 to the end of the panels so as to simplify the preparation of the supports.

For example, also the window glazing of the outer walls may be mobile in respect of some of them while the others are fixed, each mobile window glazing being capable of opening in two positions, namely partly open for low ventilation and fully open by a sliding thereof.

Exterior venetian blinds having orientable and retractable metal slats may provide protection against the sun and retractable inner blinds, for example made from a foam-fabric sandwich structure, may ensure isothermal conditions at night.

It is also possible, for example for hot countries which have a lot of sun, to reduce the window glazing and replace them by solid panels and/or provide continuous pentices.

Figure 14:
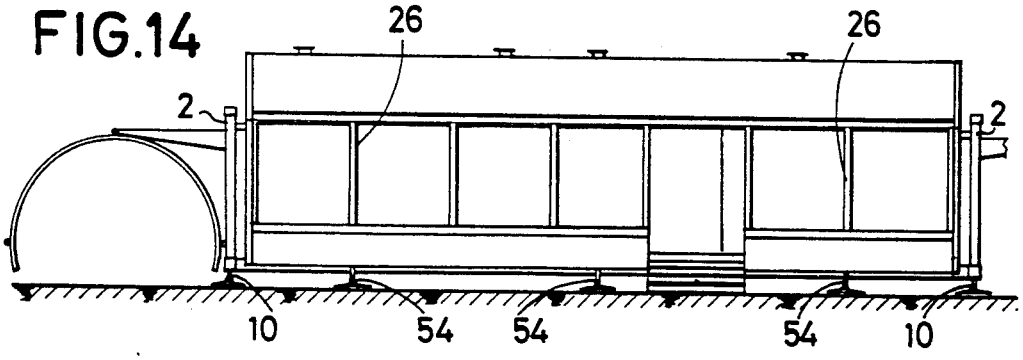
FIG. 14 is a side elevational view of one side of the house.

Other possible modifications are: the uprights of the end elements 2 are equipped with bows for receiving a marquee for protecting the axial entrance or a garage may be attached as shown in FIG. 14.

In the chosen example, the framework of the garage comprises three longitudinal bars carrying rigid arches covered with a fabric. One of the bars is connected to bows, a second bar is connected to the end element 2 and the third bar is free. The ridge of the roof may be provided with aeration means which may or may not be movable and/or localized windows for zenith lighting.

On the other hand, it is also possible to close the gaps between the struts 55 and 56 with solid panels.

There may also be provided furniture specially adapted for a folding house, for example having several positions, namely for a table: a normal upper position, a semi-folded lower position and a folded up position for transport. Such furniture could be transported in the folded up house inside the ladder-girder or even on each side of the latter.

As concerns the loading, unloading, opening out and folding up operations, they could be assisted mechanically with possibly an electric power supply from the battery of the transporting truck with the motor running.

What is claimed is:

1. A folding house comprising component elements which constitute, in a folded up position of the house, a closed and sealed container in which container are folded up all other component elements of the house, lateral walls of the container in the folded up position of the housing being formed by panels of a floor of the house while an upper wall of the container is formed by panels constituting corbelling walls of the house in the opened out position of the house, the house comprising an axial bay formed by a ladder-girder constituting a longitudinal framework which ensures the stability and the bracing of the opened out house and the rigidity of the container in the folded up position of the house, an end element connected to each end of said ladder-girder raising and opening out means formed by jacks having racks being pivotally mounted on said end elements, and said house comprising roof elements to which said racks are adapted to be connected, two racks being pivotally connected to each end element on opposite sides of each end element and for rotation about a horizontal axis near a middle of each rack, each rack having a first end engaged on said floor with said component elements folded and a stop block near a second end of each rack, each rack being pivotable by about 180° to engage its stop block against an outer edge of said floor with said rack outside said bay and said component elements unfolded.

2. A folding house according to claim 1, wherein said roof elements are each fixed to one end of a post through a gusset, said posts being pivotally mounted by the opposite end on opposed upper edges of said ladder-girder.

3. A folding house according to claim 1, comprising roof elements having an exterior edge and outer wall elements having an exterior edge, and two semi-section members interconnecting respective exterior edges so as to connect said roof elements and respective outer wall elements to pivot about a common axis, said semi-section members together forming a first beam in the folded up position of the house and a second beam having a different profile in the opened out position of the house.

4. A folding house according to claim 1, wherein each of said end elements is a tubular frame fixed to each end of the ladder-girder, said frame including in each corner a reinforcing and supporting block whereby it is possible to stack containers each formed by a folded up house.

5. A folding house according to claim 1, wherein kitchen equipment and sanitary equipment of the house are mounted on the ladder-girder.

* * * * *